US011754256B2

(12) United States Patent
Van Bommel et al.

(10) Patent No.: US 11,754,256 B2
(45) Date of Patent: Sep. 12, 2023

(54) ILLUMINATION DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL); Johannes Petrus Maria Ansems, Hulsel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/920,909

(22) PCT Filed: Apr. 30, 2021

(86) PCT No.: PCT/EP2021/061418
§ 371 (c)(1),
(2) Date: Oct. 24, 2022

(87) PCT Pub. No.: WO2021/224131
PCT Pub. Date: Nov. 11, 2021

(65) Prior Publication Data

US 2023/0167965 A1 Jun. 1, 2023

(30) Foreign Application Priority Data

May 7, 2020 (EP) ..... 20173466

(51) Int. Cl.
*F21V 7/00* (2006.01)
*F21V 23/00* (2015.01)
*F21V 7/04* (2006.01)

(52) U.S. Cl.
CPC ..... *F21V 7/0083* (2013.01); *F21V 7/04* (2013.01); *F21V 23/003* (2013.01)

(58) Field of Classification Search
CPC ..... F21V 7/0083; F21V 7/04; F21V 23/003
See application file for complete search history.

(56) References Cited

U.S. PATENT DOCUMENTS

| | | | | |
|---|---|---|---|---|
| 7,360,924 | B2 * | 4/2008 | Henson | G02B 6/0073 362/241 |
| 8,162,498 | B2 * | 4/2012 | Ramer | F21V 14/003 362/293 |
| 2003/0189829 | A1 * | 10/2003 | Shimizu | F21V 29/70 362/240 |
| 2011/0249438 | A1 * | 10/2011 | Han | F21V 17/02 362/241 |
| 2012/0044682 | A1 * | 2/2012 | Allen | G02B 27/0955 362/241 |

(Continued)

FOREIGN PATENT DOCUMENTS

| | | | |
|---|---|---|---|
| CH | 697541 | B1 | 11/2008 |
| CN | 203068203 | U | 7/2013 |

(Continued)

*Primary Examiner* — Bryon T Gyllstrom

(57) ABSTRACT

The invention relates to an illumination device (10) comprising a plurality of concave shaped reflectors (20-1, 20-2), each reflector forming a reflector cavity (25) in which a light source (21) is provided for emitting light towards a light emission window (24). The illumination device of the above known kind is capable of emitting different light emission distribution thus improving its implementation in indoor applications.

15 Claims, 8 Drawing Sheets

(56) References Cited

U.S. PATENT DOCUMENTS

Figure 1A:
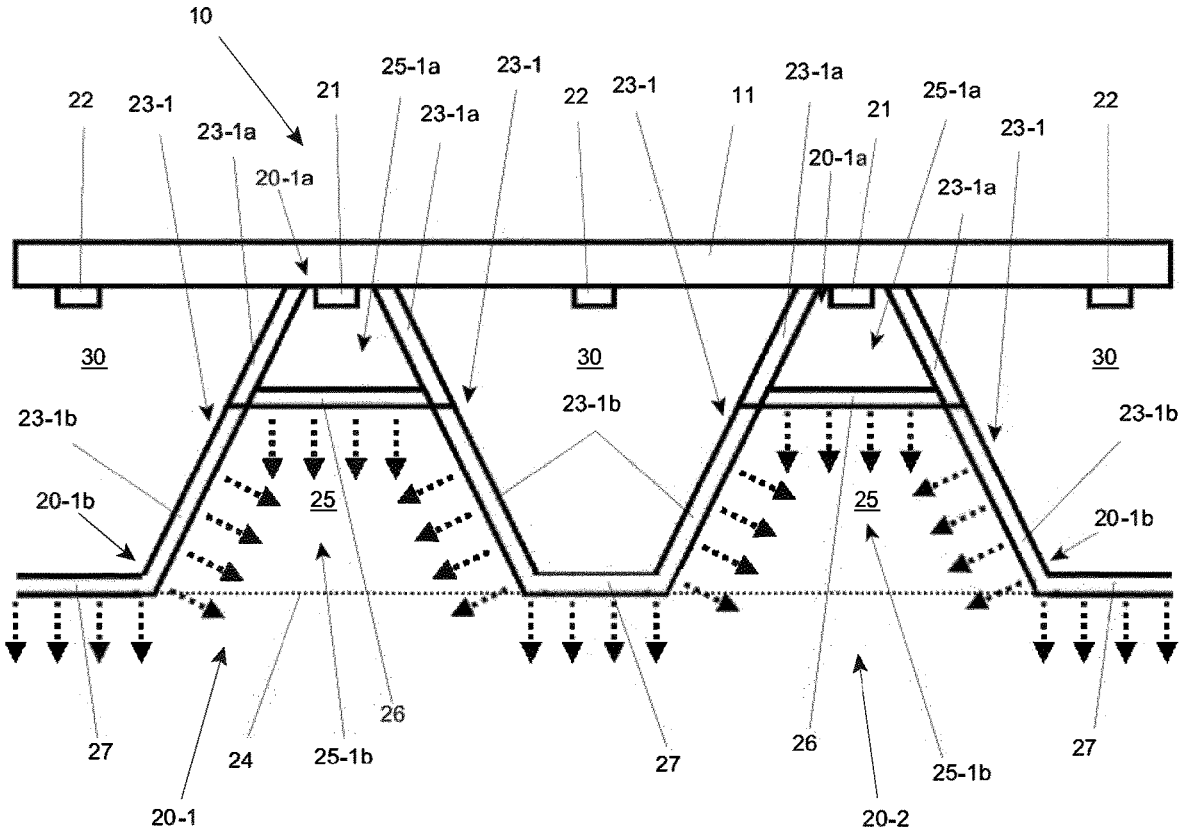

| | | | | |
|---|---|---|---|---|
| 2012/0051050 | A1 | 3/2012 | Lee et al. | |
| 2012/0140462 | A1* | 6/2012 | Pickard | G02B 19/0066 359/728 |
| 2012/0281418 | A1* | 11/2012 | Eckert | F21V 7/048 362/306 |
| 2018/0017231 | A1 | 1/2018 | Shih | |

FOREIGN PATENT DOCUMENTS

| | | | |
|---|---|---|---|
| WO | 2012042429 | A2 | 4/2012 |
| WO | 2015184457 | A1 | 12/2015 |
| WO | 2016073207 | A1 | 5/2016 |

* cited by examiner (A)

(B)

ILLUMINATION DEVICE

CROSS-REFERENCE TO PRIOR APPLICATIONS

This application is the U.S. National Phase application under 35 U.S.C. § 371 of International Application No. PCT/EP2021/061418, filed on Apr. 30, 2021, which claim the benefit of European Patent Application No. 20173466.2, filed on May 7, 2020. These applications are hereby incorporated by reference herein.

TECHNICAL FIELD

The invention relates to an illumination device comprising a plurality of concave shaped reflectors, each reflector forming a reflector cavity in which a light source is provided for emitting light towards a light emission window.

BACKGROUND OF THE INVENTION

An illumination device as outlined above is for example disclosed in the International patent application no. WO2012/042429. The illumination device described therein allows the use of a plurality of concave shaped reflectors in different number, shapes and sizes (i.e. linear and/or area configurations). Such illumination device provides a good-quality lighting solution for direct replacement of so-called T5 fluorescent lamps in office and other indoor applications. The illumination device according to WO2012/042429 consists of several concave shaped reflectors or reflective cups, wherein each cup contains a LED light source and a diffuser as an optical element between the light source and the light emission window formed by the plurality of reflectors. Each optical element accommodated in a reflector provides together with the light source only collimated light emission towards the light emission window.

SUMMARY OF THE INVENTION

It is desirable to provide an illumination device of the above known kind, capable of emitting different light emission distribution thus improving its implementation in indoor applications.

Accordingly, an illumination device is proposed, comprising a plurality of concave shaped reflectors, each reflector comprising a narrow end, a wide end, as well as a sloped edge wall connecting the narrow end and the wide end, thereby forming a first reflector cavity with the wide end constituting a light emission window, a first light source provided within the first reflector cavity at or near the narrow end an optical element provided within the first reflector cavity between the first light source and the light emission window, the optical element partitioning the first reflector cavity in a first chamber and a second chamber, and at least one further light source provided outside the first reflector cavity in a second reflector cavity formed by neighbouring sloped edge walls of the plurality of concave shaped reflectors.

Herewith the illumination device can be switched between the different lighting modes of collimated task lighting and ambient diffuse lighting.

In an example of the configuration of the concave shaped reflector, the first chamber is bound by a first edge wall part of the edge wall, the narrow end and the optical element; and the second chamber is bound by a second edge wall part of the edge wall, the light emission window and the optical element, with the first edge wall part having a first reflectivity R1 in the range of 90% or more and a first transmissivity T1 in the range of 3% or less, and the second edge wall part having a second reflectivity R2 in the range of 25% to 60% and a second transmissivity T2 in the range of 40% to 75%.

With this configuration of having several edge wall part exhibiting distinct different reflectivity and transmissivity factors, the concave shaped reflector functions as a semi-reflecting diffuser in order to obtain uniform light emission for ambient diffuse lighting while maintaining a high light emission efficiency for collimated task lighting.

In a functional embodiment, allowing the illumination device to be switched between the different lighting modes of collimated task lighting and ambient diffuse lighting, the first reflectivity R1 is 91% or more, in particular 92% or more and more in particular 93% or more and/or the first transmissivity T1 is 2% or less, in particular 1% or less and more in particular 0.5% or less.

Additionally, the second reflectivity R2 is in the range of 28% to 50%, more in particular in the range of 30% to 45%.

In a further example of the illumination device exhibiting an improved light emission distribution of ambient diffuse lighting, each concave shaped reflector is connected with a neighbouring reflector at their wide ends thereof by means of an interconnecting wall part, said interconnecting wall part having a third reflectivity R3 in the range of 25% to 60% and a third transmissivity T3 in the range of 40% to 75%.

In particular, the third reflectivity R3 is in the range of 28% to 50%, more in particular in the range of 30% to 45%.

Additionally, the optical element has a fourth reflectivity R4 in the range of 25% to 70% and a fourth transmissivity T4 in the range of 30% to 75% thereby improving both the light emission at the different lighting modes of collimated task lighting and ambient diffuse lighting.

In preferred embodiments, the second reflectivity R2 is equal to the third reflectivity R3 or the second reflectivity R2 is greater than the third reflectivity R3. In the latter example, the obtained effect is a better collimation of light being emitted.

In an advantageous example, the second edge wall parts, the optical element, and the interconnecting wall part of at least one concave shaped reflector are formed as a monolithic component. This example, can be made e.g. with a cost-effective and fast manufacturing technique of injection moulding, allowing the manufacturing of the monolithic component in large numbers.

In a further embodiment, the second edge wall parts, the optical element, and the interconnecting wall part of the monolithic component have different thicknesses, thus for acquiring different reflective and transmissivity factors R2-R4/T2-T4 for these different element parts of the reflector.

In a specific example, the second edge wall parts, the optical element, and the interconnecting wall part of the monolithic component have the same thickness, such that the second reflectivity R2, the third reflectivity R3 and fourth reflectivity R4 are equal to each other. Such component can for example be made with thermo/vacuum forming e.g. using extruded diffuser plates.

In a further example of the illumination device, the light-scattering optical element comprises light scattering particles contained in a matrix, wherein the light scattering particles are $Al_2O_3$, $BaSO_4$, $TiO_2$, or silicon particles, and the matrix is a polymer, for example polycarbonate, polyethylene terephthalate, polymethyl methacrylate, or polyethylene.

In yet another advantageous example, wherein the illumination device can be switched between the different lighting modes of collimated task lighting and ambient diffuse lighting,—during operation—the first light source emits light of a first type and the further light source emits further light of a second type, the illumination device further comprises a controller configured for individually controlling the first light source and the further light source in at least a first state and a second state, wherein in the first state the first light source emits light of the first type and the further light source emits light of the second type and in the second state the first light source emits light of the first type and the further light source emits no light.

Additionally, the illumination device emits homogenous lighting from all of said plurality of reflectors.

Other configurations of the illumination device, which provide additional diffuse lighting patterns, the edge wall of the first reflector cavity is arranged under an angle θ with respect to the light emission window, with θ in a range from 20° to 70°, preferably in a range from 30° to 60°, more preferably in a range of 40° to 50°. In particular the second reflector cavity comprises at least one second edge wall arranged under an angle γ with respect to the light emission window, with γ in a range from 20° to 70°, preferably in the range from 30° to 60°, and more preferably in the range of 40° to 50°.

DESCRIPTION OF THE INVENTION

Figure 1B:
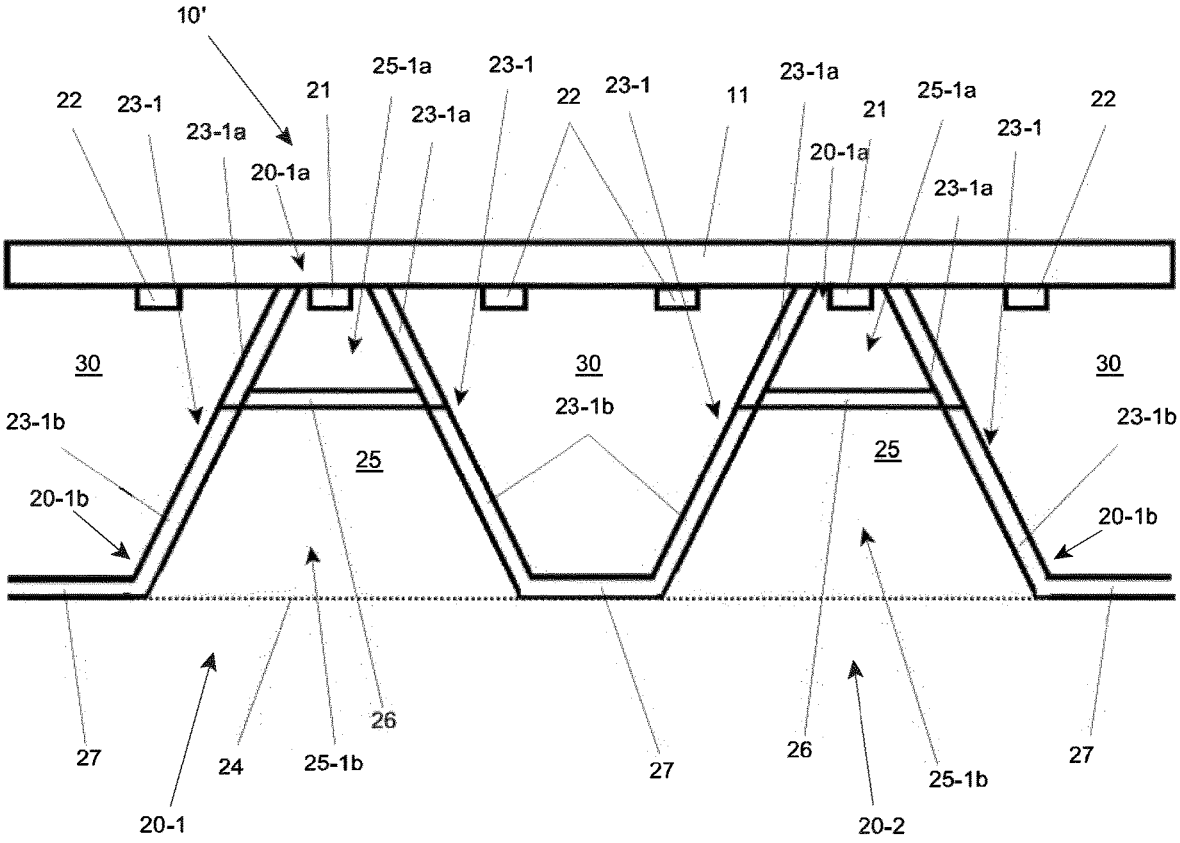
Figure 2:
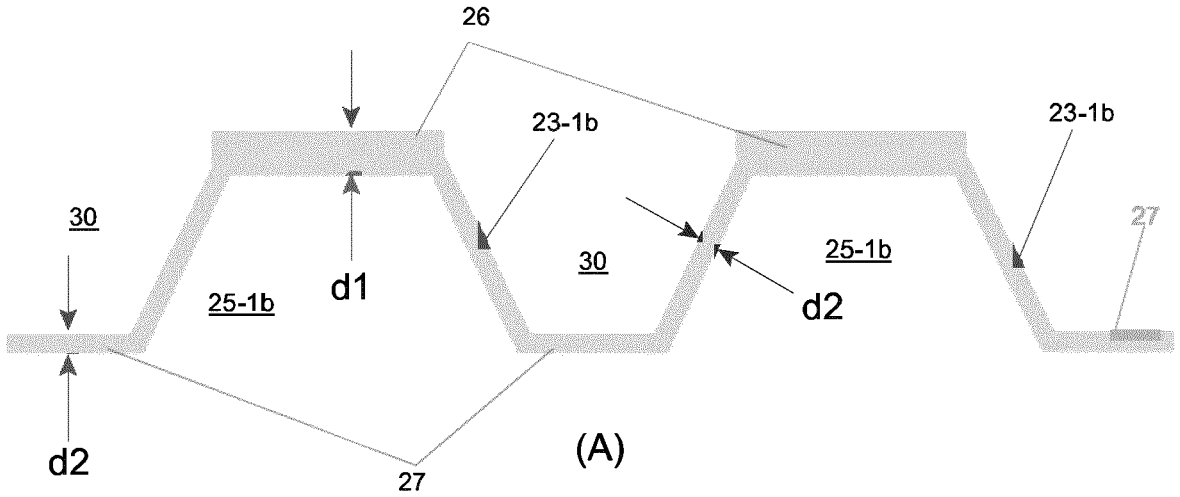
Figure 2:
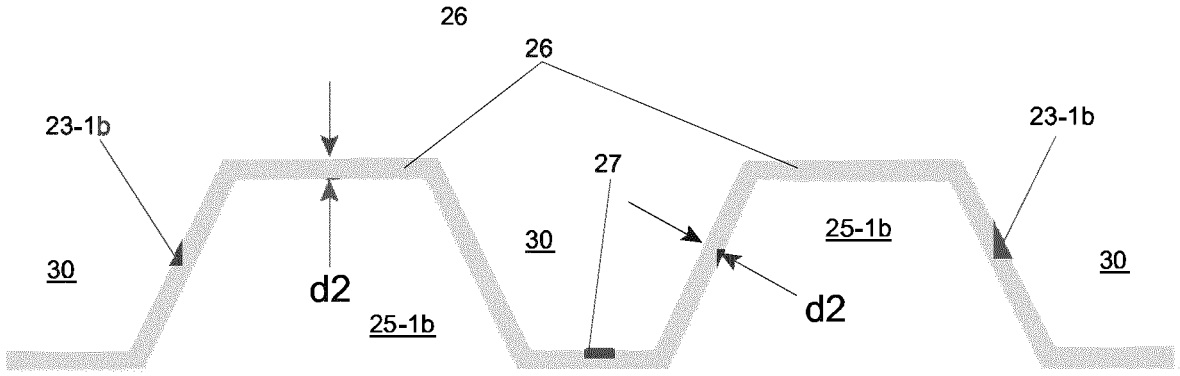
Figure 3:
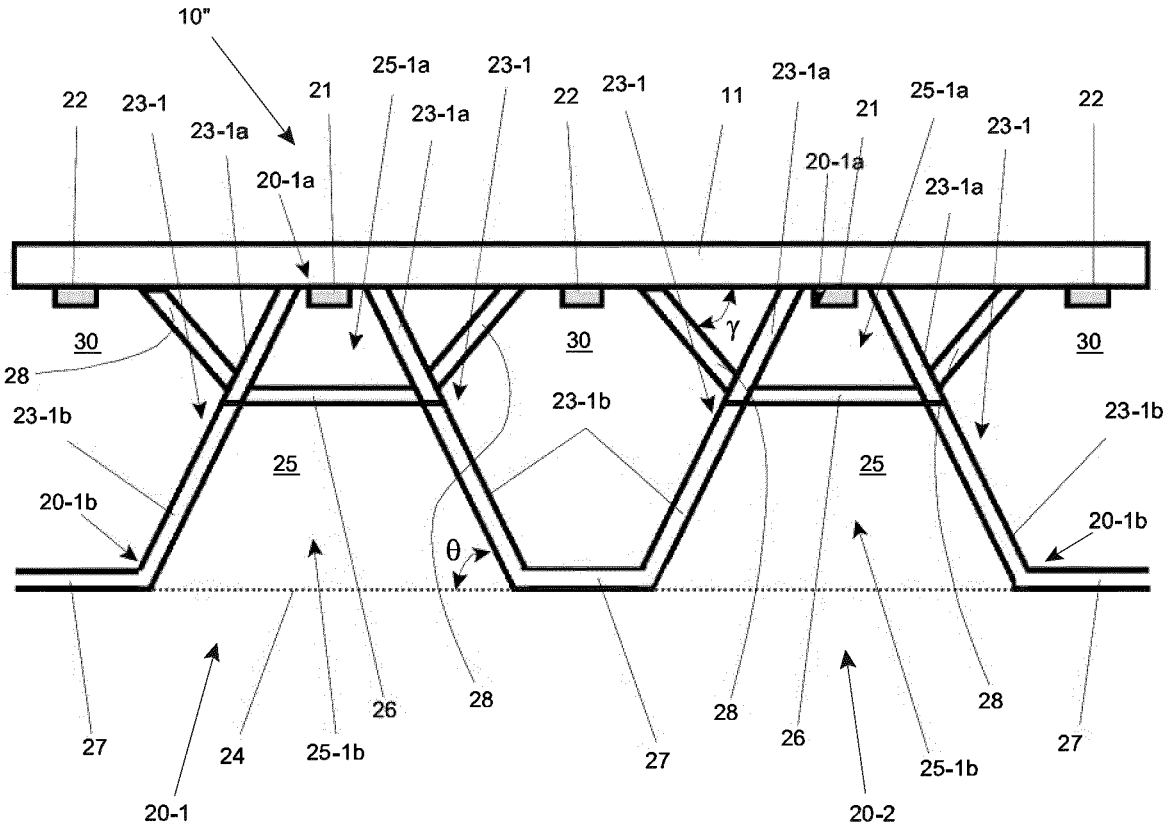
Figure 4:
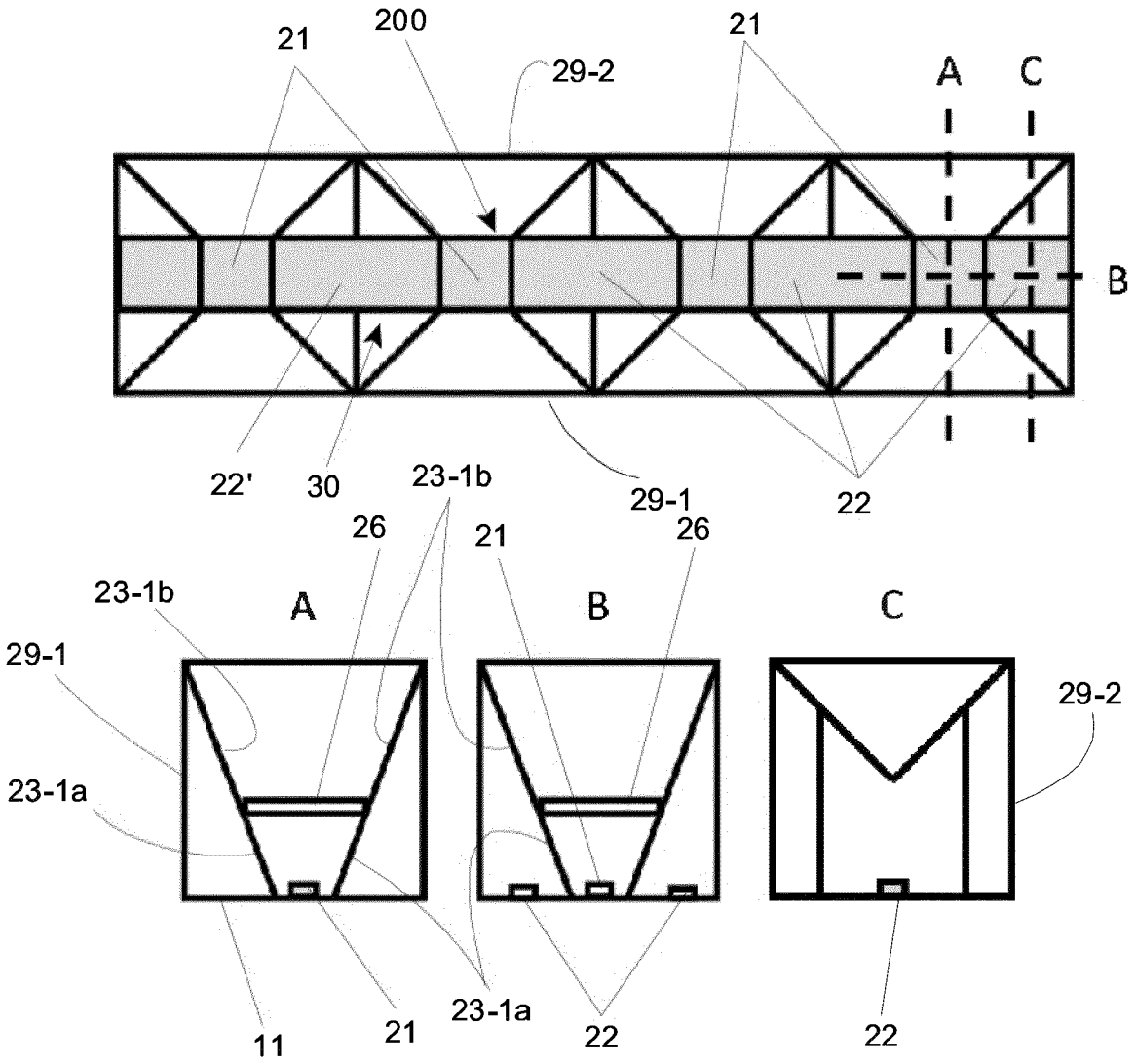
Figure 5:
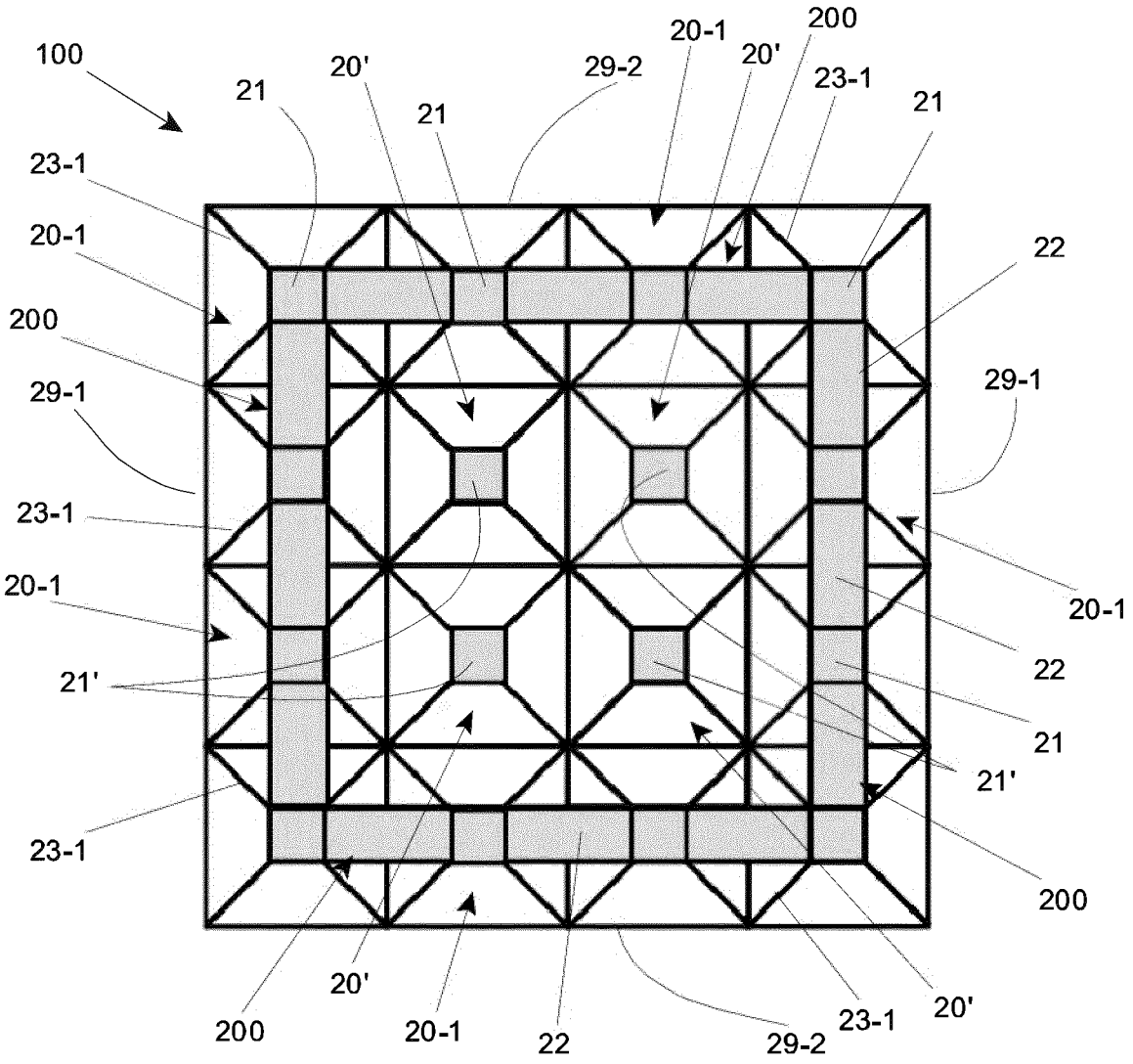
Figure 6A:
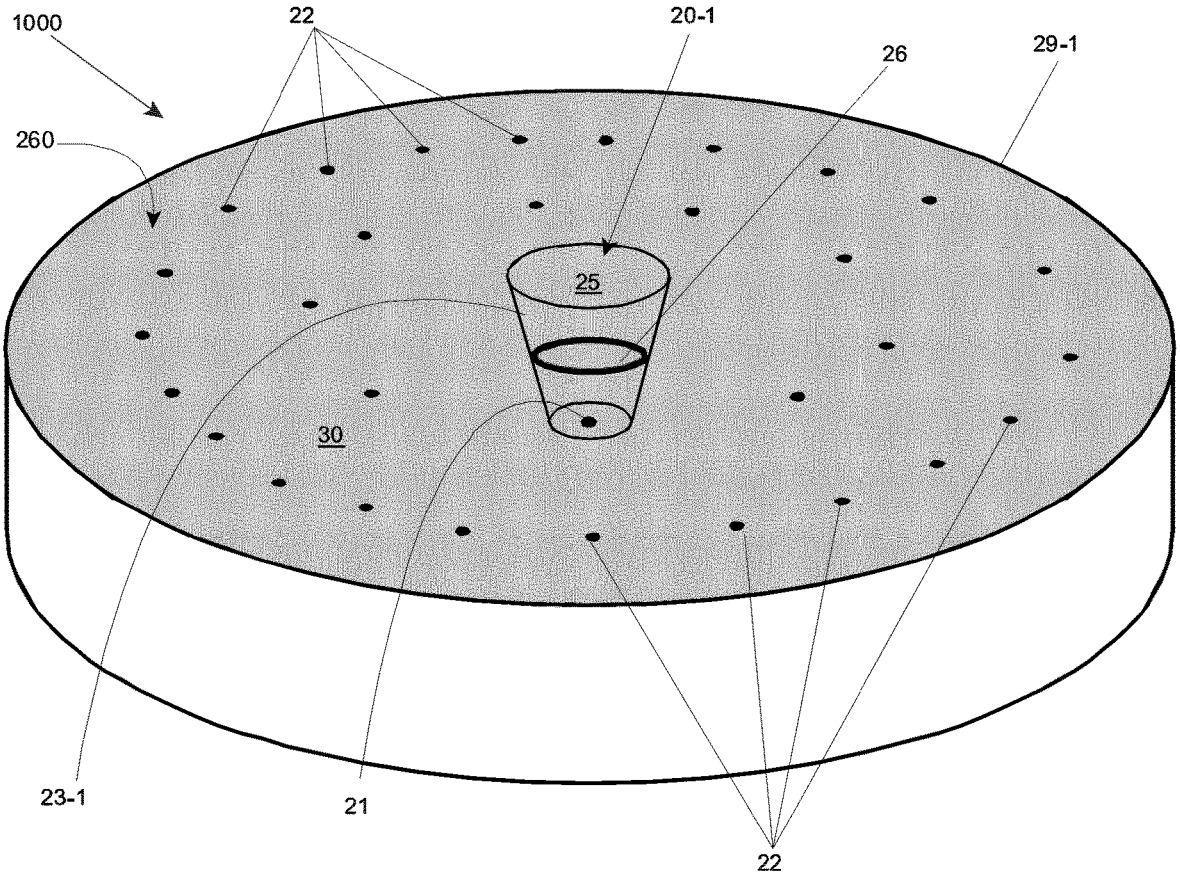
Figure 6B:
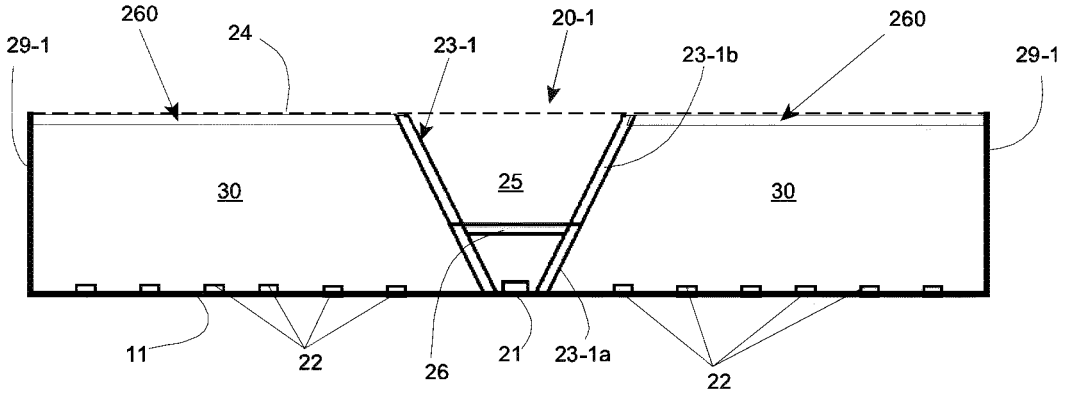

The invention will now be discussed with reference to the drawings, which show in:

FIGS. 1*a* and 1*b* schematically illustrates examples of an embodiment of an illumination device according to the present disclosure;

FIGS. 2*a* and 2*b* schematically illustrates details of a light embodiment of an illumination device according to the present disclosure;

FIG. 3 schematically illustrates another example of an embodiment of an illumination device according to the present disclosure;

FIG. 4 schematically illustrates another details of a light embodiment of an illumination device according to the present disclosure;

FIG. 5 schematically illustrates another example of an embodiment of an illumination device according to the present disclosure;

FIGS. 6*a* and 6*b* schematically illustrates another example of an embodiment of an illumination device according to the present disclosure.

DETAILED DESCRIPTION OF THE DRAWINGS

For a proper understanding of the invention, in the detailed description below corresponding elements or parts of the invention will be denoted with identical reference numerals in the drawings.

FIG. 1*a* schematically illustrate a non-limiting example of an embodiment of an illumination device according to the present disclosure. Reference numeral 10 depicts an illumination device comprising a plurality of concave shaped reflectors 20-1; 20-2. In the example of FIGS. 1*a* and 1*b* two concave shaped reflectors, however it should be note that a large number of concave shaped reflectors can be arranged in an array or linear configuration, depending on any constructional constraints of the indoor environment in which the illumination device 10 is to be installed or depending on the type of lighting application for which the illumination device 10 is intended.

The plurality (ten, twenty or even more) of concave shaped reflectors 20-1; 20-2; 20-*n* are mounted to a frame or housing 11 via which the illumination device 10 is mounted to a deck or ceiling (not shown). Each reflector 20-1; 20-2; 20-*n* is formed as a concave shaped reflector encompassing a cavity 25 and comprises a narrow end (side) 20-1*a*, and a wide end (side) 20-1*b*, as well as edge walls 23-1 connecting the narrow end 20-1*a* and the wide end 20-1*b*. The plurality (ten, twenty or even more) of concave shaped reflectors 20-1; 20-2; 20-*n* are aligned at their wide ends 20-1*b*, thus constituting a light emission window 24.

Additionally, the plurality (ten, twenty or even more) of concave shaped reflectors 20-1; 20-2; 20-*n* are interconnected with a neighbouring reflector at their wide ends 20-1*b* thereof by means of an interconnecting wall part 27. Herewith the illumination device exhibits an improved light emission distribution of ambient diffuse lighting.

Within each reflector cavity formed by the concave shaped reflectors 20-1; 20-2; 20-*n* a first light source 21 is provided at or near the narrow end 20-1*a* thereof. The first light source 21 can a plurality of white, red, green and blue (WRGB) light emitting LEDs mounted on a PCB (not shown) with a light reflective surface. The PCB can be mounted to the frame 11. In this embodiment, the RGB LEDs do not render the right colour for general illumination, but are added to the white LEDs to tune the colour. Said PCB and LEDs together are provided in the reflector cavity 25 of each concave shaped reflector 20-1; 20-2; 20-*n*, i.e. in this particular case form part of the narrow boundary end 20-1*a* of the reflector cavity.

An optical element or diffuser 26 is provided within the reflector cavity 25 between the first light source 21 and the light emission window 24 and partitions the reflector cavity 25 in a first cavity chamber 25-1*a* and a second cavity chamber 25-1*b*. The optical element or diffuser 26 functions as a light scattering element. The first cavity chamber 25-1*a* is bound or formed by a first edge wall part 23-1*a* of the edge wall 23-1, the narrow end 20-1*a* (or the PCB incorporating the first light source 21) and the optical element/diffuser 26, whereas the second cavity chamber 25-1*a* is bound by a second edge wall part 23-1*b* of the edge wall 23-1, the light emission window 24 and the optical element/diffuser 26.

In case the first light source 21 is energized, collimated light is obtained being collimated by the first reflector cavity 25.

FIG. 1*a* also depicts one further light source 22, that is provided outside the first reflector cavity formed by the two cavity chambers 25-1*a*/25-1*b* in a second reflector cavity 30 formed by the neighbouring reflectors 20-1; 20-2; 20-*n*.

In case the further light source 22 is energized, diffused light is obtained.

Although FIG. 1*a* depicts one further light source 22 in the second reflector cavity 30, the embodiment of FIG. 1*b* depicts two further light sources 22 in the second reflector cavity 30. The number of further light sources 22 in the second reflector cavity 30 formed by the neighbouring reflectors 20-1; 20-2; 20-*n* is arbitrary, but is at least one, preferably two, but can also be three or four. Also the further light sources 22 in the second reflector cavity 30 can a plurality of white, red, green and blue (WRGB) light emitting LEDs mounted on a PCB (not shown) with a light reflective surface. Similarly to the first light source 21, also the PCB carrying the further light source 22 can be mounted to the frame 11.

Preferably, and as shown in FIG. 1*b* the two further light sources 22 in the second reflector cavity 30 are mounted to the frame 11 such that the further light sources are arranged under the sloped edge walls 23-1 of the reflector cavity.

Implementing both light sources in the main concave-shape reflector and in the second cavity 30 allows the illumination device to be switched between different lighting modes of collimated task lighting and ambient diffuse lighting.

Both the boundary wall parts of the first and second cavity chambers 25-1*a* and 25-1*b* are made from a material having different reflectivity and transmissivity coefficients, with the first edge wall part 23-1*a* having a first reflectivity R1 in the range of 90% or more and a first transmissivity T1 in the range of 3% or less, and the second edge wall part 23-1*b* having a second reflectivity R2 in the range of 25% to 60% and a second transmissivity T2 in the range of 40% to 75%.

In a preferred example, the second reflectivity R2 is in the range of 28% to 50%, more in particular in the range of 30% to 45%.

Preferably, the first reflectivity R1 is 91% or more, in particular 92% or more and more in particular 93% or more and/or the first transmissivity T1 is 2% or less, in particular 1% or less and more in particular 0.5% or less.

In all these functional embodiments, the illumination device and in particular the first and further light sources 21 and 22 can be effectively to be switched between different lighting modes of collimated task lighting and ambient diffuse lighting.

Additionally, the interconnecting wall parts 27 interconnecting neighbouring concave shaped reflectors 20-1; 20-2 at their wide ends 20-1*b* thereof is made from a material having a third reflectivity R3 in the range of 25% to 60% and a third transmissivity T3 in the range of 40% to 75%. Preferably, the third reflectivity R3 is in the range of 28% to 50%, more in particular in the range of 30% to 45%. This also improves both the light emission at the different lighting modes of collimated task lighting and ambient diffuse lighting.

The optical element or diffuser 26 is made from a material having a fourth reflectivity R4 in the range of 25% to 70% and a fourth transmissivity T4 in the range of 30% to 75%.

In an alternative embodiment resulting in an improved collimation of light being emitted, the second reflectivity R2 is equal to the third reflectivity R3 or the second reflectivity R2 is greater than the third reflectivity R3.

FIGS. 2*a* and 2*b* show a detail of the examples of an illumination device according to the invention. The detail of FIGS. 2*a* and 2*b* pertains to the second edge wall parts 23-1*b*, the optical element or diffuser 26 and the interconnecting wall parts 27 of neighbouring concave shaped reflectors 20-1, 20-2, 20-*n*, which parts are formed as a monolithic component. Such monolithic component can be made with cost-effective and fast manufacturing techniques, such as injection moulding, allowing the manufacturing of the monolithic component in large numbers.

As shown in FIG. 2*a*, the second edge wall parts 23-1*b*, the optical element (diffuser) 26, and the interconnecting wall part 27 of the monolithic component have a different thickness, indicated with d1 for the thickness of the optical element (diffuser) 26 and with d2 for the thickness of both the second edge wall parts 23-1*b* and the interconnecting wall part 27. Preferably d1>d2, and by increasing the thickness by for example two (2) would also chance the reflection by two. Although in FIG. 2*a* the thickness d2 of both the second edge wall parts 23-1*b* and the interconnecting wall part 27 are the same, in yet another example (not shown) these thicknesses of the second edge wall parts 23-1*b* and the interconnecting wall part 27 can differ from each other. For example, in one combination d2 is e.g. 2 mm, and D1 is e.g. 1 mm, whereas in another combination d2 is e.g. 3 mm, and d1 is e.g. 2 mm.

By providing these parts of the reflector 20-1 (20-2, 20-*n*) with different thicknesses d1 and d2, different reflective and transmissivity factors R2-R3-R4/T2-T3-T4 can be allocated to these parts of the reflector.

With such configuration of having several edge wall part exhibiting distinct different reflectivity and transmissivity factors, the concave shaped reflector functions as a semi-reflecting diffuser in order to obtain uniform light emission for ambient diffuse lighting while maintaining a high light emission efficiency for collimated task lighting.

In a specific example as shown in FIG. 2*b*, the second edge wall parts 23-1*b*, the optical element (diffuser) 26, and the interconnecting wall part 27 of the monolithic component have the same thickness d2, such that the second reflectivity R2, the third reflectivity R3 and fourth reflectivity R4 are equal to each other. Such component can for example be made with thermo/vacuum forming e.g. using extruded diffuser plates.

To further improve the lighting characteristics of the illumination device the optical element or diffuser 26 comprises light scattering particles, which particles are contained in a matrix. The particles are generally homogenous distributed in the matrix forming the optical element or diffuser 26. The light scattering particles can be selected but not limited from a group containing $Al_2O_3$, $BaSO_4$, $TiO_2$, or silicon particles. In a further example the matrix containing these particles is a polymer, for example polycarbonate, polyethylene terephthalate, polymethyl methacrylate, or polyethylene.

By changing the layer thickness and/or reflective particle concentration in any of the optical element 26, the edge wall parts 23-1*a* and 23-1*b*, and the interconnecting wall part 27 the reflection and light transmission properties can be altered and controlled.

In an example of the illumination device capable of being switched between the different lighting modes of collimated task lighting and ambient diffuse lighting,—during operation—the first light source 21 emits light of a first type and the further light source (or sources) 22 emits further light of a second type. For such switching between light modes, the illumination device 10-10'-100 further comprises a controller configured for individually controlling the first light source 21 and the further light source 22 in at least a first state and a second state, wherein in the first state the first light source 21 emits light of the first type and the further light source 22 emits light of the second type and in the second state the first light source 21 emits light of the first type and the further light source 22 is switched off and emits no light.

It is noted that the light of a first type is emitted by the first light source 21 with a controllable light intensity L1 and the light of the second type is emitted by the further light source(s) 22 with a controllable light intensity L2. In an example, the controller controls in the first state both first and further lighter sources 21 and 22 such, that L1=x (candela or cd) and L2=y (cd), whereas in the second state the controller controls both first and further lighter sources 21 and 22 such, that L1=z (cd) and L2=0 (cd). In those lighting states the light intensities L1 and L2 are such, that x<y and z>x.

Additionally, the illumination device can emit homogenous lighting from all of said plurality of reflectors.

Another configuration of the illumination device is depicted in FIG. 3, which embodiment provide additional diffuse lighting patterns. Hereto the edge wall 23-1 (23-1*a* and 23-1*b*) of the first reflector cavity 25-1*a*/25-1*b* is arranged under an angle θ with respect to the light emission window 24, with θ in a range from 20° to 70°, preferably in a range from 30° to 60°, and more preferably in a range of 40° to 50°. Additionally, in another example also depicted in FIG. 3 the second reflector cavity 30 is provided with a second edge wall 28 arranged under an angle γ with respect to the light emission window 24. As shown in FIG. 3 this second edge wall 28 connects with one end to the frame 11 and with its other end to the edge wall 23-1, in particular to the first edge wall part 23-1*a* near the optical element 26. For an optimal lighting effect, the angle γ ranges from 20° to 70°, preferably in the range from 30° to 60°, and more preferably in the range of 40° to 50°.

Similar as to the first edge wall 23-1 being dived in a first and second edge wall part 23-1*a*/23-1*b*, each being made of a material having a different first and second reflectivity R1/R2 and a different first and second transmissivity T1/T2, also the second edge wall 28 of the second cavity 30 may have at least one first wall part and at least one second wall part having different light transmissions T. Such configurations also provides additional diffuse lighting patterns.

As outlined, the number of further light sources 22 in the second reflector cavity 30 formed by the neighbouring reflectors 20-1; 20-2; 20-*n* is arbitrary, but is at least one, preferably two, but can also be three or four. As shown in FIG. 4 these further light sources 22 may be clustered in different chambers of the concave-shaped reflector 20-1; 20-2; 20-*n*. FIG. 4 shows a configuration of clustered further light sources 22 providing diffuse lighting patterns. For example, the further light source 22' accommodated in the second cavity 30 may have the same width of the interconnecting wall part 27.

The first and further light sources 21-22 may be applied on a single carrier 200 e.g. a PCB such as for example a LED strip 200. A single LED carrier trip 200 may be used for a linear array of n concave-shaped reflectors 20-1; 20-2; 20-*n*. Multiple LED strips or carriers 200 may be used for a two-dimensional matrix of concave-shaped reflectors 20-1; 20-2; 20-*n* as, an example is depicted in FIG. 5.

FIG. 5 shows an illumination device 100 shaped in a two-dimensional matrix of concave-shaped reflectors 20-1; 20-2; 20-*n* implementing first and further light sources 21-22 in first and second reflector cavities 25-30, which surround four concave-shaped reflectors 20' only implementing a first light source 21'. The complete matrix 100 is provided with side walls 29-1.

FIGS. 6*a* and 6*b* (side view of FIG. 6*a*) depict yet another example of an illumination device 1000, schematically depicted as being composed of one circular shaped fixture having a circumferential side wall 29-1 surrounding the second reflector cavity 30 as well as one concave-shaped reflector 20-1 forming the first reflector cavity 25 and being positioned in the centre of the circular shaped fixture. The second reflector cavity 30 is provided with a plurality of further light sources 22 provided on the frame 11 in either an arbitrary distribution pattern or in a regular distribution pattern, for example in concentric circles around the centre-placed concave-shaped reflector 20-1.

The second reflector cavity 30 is provided with a semi-reflective diffuser element 260 made from a material having a reflectivity of 35%, and a transmission of about 60%. To further improve the lighting characteristics of the illumination device 1000 also the diffuser element 260 may comprise light scattering particles. The particles are generally homogenous distributed within the diffuser element 260, preferably in a matrix. The light scattering particles can be selected but not limited from a group containing $Al_2O_3$, $BaSO_4$, $TiO_2$, or silicon particles. In a further example the matrix containing these particles is a polymer, for example polycarbonate, polyethylene terephthalate, polymethyl methacrylate, or polyethylene. By changing the layer thickness and/or reflective particle concentration in diffuser element 260 the reflection and light transmission properties can be altered and controlled.

A first light source 21 is arranged inside the concave-shaped reflector cavity 25 as well as a diffuser 26, similar to the embodiment of FIGS. 1*a* and 1*b*. In case the first light source 21 is energized, collimated light is obtained being collimated by the first reflector cavity 25.

It is noted that such a single circular shaped illumination device 1000 is part of the invention, yet is not claimed as such. It is further noted that the illumination device 1000 can be composed of multiple circular shaped fixtures as depicted in FIGS. 6*a* and 6*b*, which circular shaped fixtures can be mounted in a linear array or two-dimensional matrix array and that such arrays fall within the claimed scope of the invention. When arranged in such a linear array or two-dimensional matrix array, the circumferential side wall 29-1 between two neighbouring reflectors is removed, so that the second reflector cavity 30 is formed by the sloped edge walls of neighbouring reflectors of the plurality of reflectors.

The invention claimed is:

1. An illumination device comprising:

a plurality of concave shaped reflectors, each reflector comprising a narrow end, a wide end, as well as a sloped edge wall connecting the narrow end and the wide end, thereby forming a first reflector cavity with the wide end constituting a light emission window, a first light source provided within the first reflector cavity at or near the narrow end, an optical element provided within the first reflector cavity between the first light source and the light emission window, the optical element partitioning the first reflector cavity in a first chamber and a second chamber, at least one further light source provided outside the first reflector cavities in a second reflector cavity formed by neighbouring sloped edge walls of the plurality of concave shaped reflectors.

2. The illumination device according to claim 1, wherein the first chamber is bound by a first edge wall part of the edge wall, the narrow end and the optical element; and the second chamber is bound by a second edge wall part of the edge wall, the light emission window and the optical element, with the first edge wall part having a first reflectivity R1 in the range of 90% or more and a first transmissivity T1 in the range of 3% or less, and the second edge wall part having a second reflectivity R2 in the range of 25% to 60% and a second transmissivity T2 in the range of 40% to 75%.

3. The illumination device according to claim 2, wherein the second reflectivity R2 is in the range of 28% to 50%, more in particular in the range of 30% to 45%.

4. The illumination device according to claim 1, wherein each concave shaped reflector is connected with a neighbouring reflector at their wide ends thereof by means of an interconnecting wall part, said interconnecting wall part having a third reflectivity R3 in the range of 25% to 60% and a third transmissivity T3 in the range of 40% to 75%.

5. The illumination device according to claim 4, wherein the third reflectivity R3 is in the range of 28% to 50%, more in particular in the range of 30% to 45%.

6. The illumination device according to claim 1, wherein the optical element has a fourth reflectivity R4 in the range of 25% to 70% and a fourth transmissivity T4 in the range of 30% to 75%.

7. The illumination device according to claim 2, wherein the second reflectivity R2 is equal to the third reflectivity R3 or the second reflectivity R2 is greater than the third reflectivity R3.

8. The illumination device according to claim 4, wherein the second edge wall parts, the optical element, and the interconnecting wall part of at least one concave shaped reflector are formed as a monolithic component.

9. The illumination device according to claim 8, wherein the second edge wall parts, the optical element, and the interconnecting wall part of the monolithic component have different thicknesses.

10. The illumination device according to claim 8, wherein the second edge wall parts, the optical element, and the interconnecting wall part of the monolithic component have the same thickness, such that the second reflectivity R2, the third reflectivity R3 and fourth reflectivity R4 are equal to each other.

11. The illumination device according to claim 1, wherein the optical element comprises light scattering particles contained in a matrix.

12. The illumination device according to claim 1, wherein—during operation—the first light source emits light of a first type and the further light source emits further light of a second type, and wherein the illumination device further comprises a controller configured for individually controlling the first light source and the further light source in at least a first state and a second state, wherein in the first state the first light source emits light of the first type and the further light source emits light of the second type and in the second state the first light source emits light of the first type and the further light source emits no light.

13. The illumination device according to claim 1, wherein the illumination device emits homogenous lighting from all of said plurality of reflectors.

14. The illumination device according to claim 1, wherein the edge wall of the first reflector cavity is arranged under an angle θ with respect to the light emission window, with θ in a range from 20° to 70°, preferably in a range from 30° to 60°, more preferably in a range of 40° to 50°.

15. The illumination device according to claim 1, wherein the second reflector cavity comprises at least one second edge wall arranged under an angle γ with respect to the light emission window, with γ in a range from 20° to 70°, preferably in the range from 30° to 60°, and more preferably in the range of 40° to 50°.

* * * * *